US007537173B1

(12) United States Patent
Kogan

(10) Patent No.: US 7,537,173 B1
(45) Date of Patent: May 26, 2009

(54) DRINKING STRAW FOR HEATED LIQUIDS, METHOD OF COOLING AND COMBINATION WITH DRINKING VESSELS

(76) Inventor: Gennady S. Kogan, 195 Ladue Oaks Ct., Creve Coeur, MO (US) 63141

( * ) Notice: Subject to any disclaimer, the term of this patent is extended or adjusted under 35 U.S.C. 154(b) by 480 days.

(21) Appl. No.: 11/447,804

(22) Filed: Jun. 6, 2006

Related U.S. Application Data

(60) Provisional application No. 60/687,726, filed on Jun. 6, 2005.

(51) Int. Cl.
*A47G 21/18* (2006.01)

(52) U.S. Cl. ..... 239/33; 239/16; 239/24; 239/22

(58) Field of Classification Search ..... 239/33, 239/30, 22, 24; 392/465, 466, 478
See application file for complete search history.

(56) References Cited

U.S. PATENT DOCUMENTS

| | | | | |
|---|---|---|---|---|
| 1,236,029 | A | 8/1917 | Williams | |
| 2,435,033 | A * | 1/1948 | Campbell | 215/387 |
| 2,570,366 | A | 10/1951 | Mitchell | |
| 2,943,794 | A * | 7/1960 | Sussman | 239/33 |
| 2,997,195 | A | 8/1961 | Yuen | 215/100 |
| 3,409,224 | A | 11/1968 | Harp et al. | 239/33 |
| 3,517,884 | A * | 6/1970 | Horvath | 239/33 |
| 3,718,282 | A | 2/1973 | Pizzoferrato | 239/33 |
| 3,972,326 | A * | 8/1976 | Brawn | 128/202.15 |
| 4,085,861 | A | 4/1978 | Ruff | 220/90.4 |
| D275,542 | S | 9/1984 | Hacke | D7/42 |
| 4,582,213 | A | 4/1986 | Park et al. | 220/90.2 |
| 4,850,533 | A | 7/1989 | Hoshi et al. | 239/33 |
| 5,031,831 | A | 7/1991 | Williams, III | 239/33 |
| D320,136 | S | 9/1991 | Adcock et al. | D7/300.2 |
| 5,067,637 | A | 11/1991 | Aurness et al. | 222/175 |
| 5,160,087 | A * | 11/1992 | Mandell | 239/33 |
| 5,288,019 | A | 2/1994 | Gorochow | 239/33 |
| 5,361,987 | A | 11/1994 | Matheussen et al. | 239/33 |
| 5,409,131 | A | 4/1995 | Phillips et al. | 220/717 |
| 5,513,762 | A | 5/1996 | Janani | 215/229 |
| 5,626,022 | A | 5/1997 | Scudder et al. | 62/4 |
| 5,947,378 | A | 9/1999 | Rebotier | 239/33 |
| D444,022 | S * | 6/2001 | Katsukawa | D7/300.2 |
| 6,702,193 | B1 * | 3/2004 | Gates | 239/33 |
| 6,802,438 | B2 | 10/2004 | Thompson | 222/175 |
| 6,929,191 | B2 * | 8/2005 | Kim | 239/33 |

(Continued)

OTHER PUBLICATIONS

Bubble Formation and Bubble Rise Velocity in Gas-Liquid Systems: A Review; Ind. Eng. Chem. Res. 2005, 44, 5873-5931.

*Primary Examiner*—Thor S Campbell
(74) *Attorney, Agent, or Firm*—Irina Shumakovich

(57) ABSTRACT

A drinking straw for delivering a hot liquid in the form of a foam into a user's mouth that mimics the natural action of sucking in air for cooling the liquid. The straw has a tube wall with an expanded portion proximate an outlet. Air admitting orifices are provided in the tube wall below the expanded portion so that air is drawn into the straw through the orifices when a liquid is sucked through the straw. The straw may be used for cooling a hot liquid such as coffee, tea, soup or the like and may be used in connection with a container.

9 Claims, 11 Drawing Sheets

U.S. PATENT DOCUMENTS

2001/0010849 A1 8/2001 Blizard et al. ..... 428/36.5
2001/0019062 A1 9/2001 Kalagian ..... 220/705
2002/0030115 A1 3/2002 Float et al. ..... 239/33
2002/0079320 A1 6/2002 McCarthy et al. ..... 220/705
2002/0121495 A1 9/2002 Kozlov ..... 215/229
2003/0006293 A1 1/2003 Lee ..... 239/33
2003/0218017 A1 11/2003 Schmidtner et al. ..... 220/254.5
2005/0092319 A1 5/2005 Payen et al. ..... 126/263.09

* cited by examiner

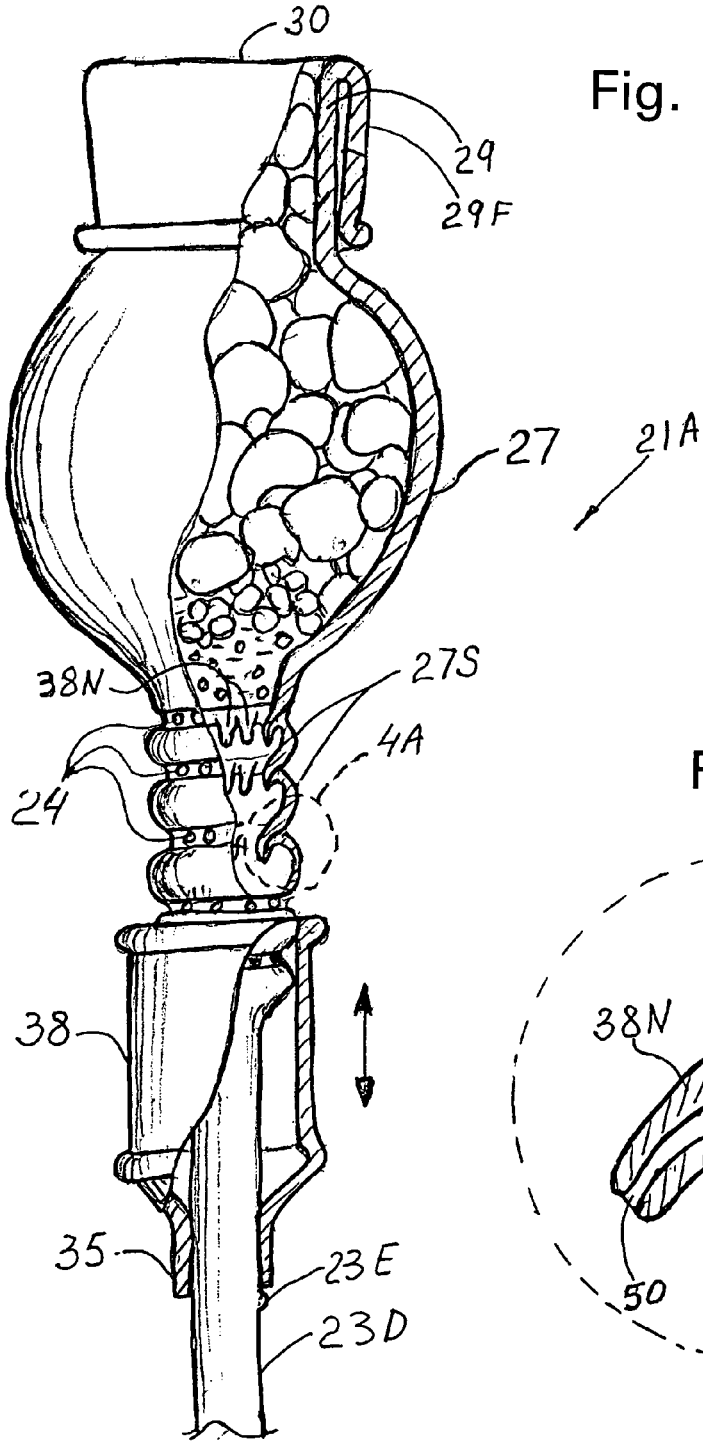
Fig. 4
Fig. 4A
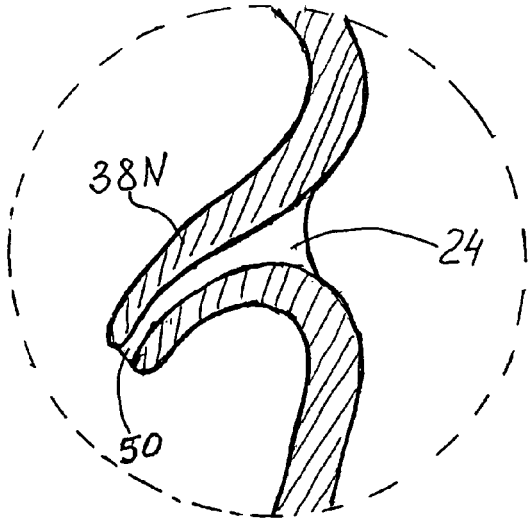

DRINKING STRAW FOR HEATED LIQUIDS, METHOD OF COOLING AND COMBINATION WITH DRINKING VESSELS

This application claims priority from provisional application Ser. No. 60/687,726, filed Jun. 6, 2005, for Drinking Straw for Heated Liquids, Method of Cooling and Combination with Drinking Vessels.

BACKGROUND OF THE INVENTION

1. Field of the Invention

The present invention relates to a drinking straw which delivers a hot liquid into the mouth of a user in the form of a foam and to a method wherein the hot liquid is cooled in the user's mouth as the foam collapses such that the mouth of the user is not burned. The drinking straw may be provided separately or in combination with a drinking vessel.

2. Brief Description of the Prior Art

To reduce the chance of burning the mouth, people instinctively sip a hot liquid. The sipping process mixes the hot liquid with air, thus creating an air-liquid mixture. The air keeps the liquid from burning the user's mouth while the liquid cools.

Other than with the natural technique, inventive attention has been directed to cooling the hot liquid before it reaches the user's mouth. But a cooled drink and a hot drink have different flavors. U.S. Pat. No. 5,288,019 to Gorochow is illustrative of the prior art.

The idea of perforating a straw such it introduces bubbles into a drink for the purpose of improving the drink's palatability was described in U.S. Pat. No. 2,943,794 to Sussman. The tube wall in the Sussman patent is straight and the bubbles introduced into the drink tend to be small. When such a straw is used with a hot liquid, the liquid is slightly cooled as it flows through the straw but it is still hot when it reaches a user's mouth and the bubbles are not large enough to effectively form a foam.

In view of the above, what is needed is a drinking straw and a method of cooling a hot liquid that mimics the natural action of sucking in air for cooling the liquid.

BRIEF SUMMARY OF THE INVENTION

In view of the above, it is an object of the present invention to provide a drinking straw and a method of cooling that mimics the natural action of sucking in air for cooling a hot liquid. It is another object to provide a drinking straw and a method of using it for delivering a hot liquid into the mouth of a user without substantially precooling the liquid. Other objects and features of the invention will be in part apparent and in part pointed out hereinafter.

In accordance with the invention, a drinking straw is provided with a tube wall having an inlet on the lower end and an outlet on the upper end. The tube wall has at least one expanded portion proximate the outlet. The volume of the expanded portion is larger than the volume of the tube below the expanded portion such that the pressure on a hot liquid being drawn through the straw is reduced in the expanded portion.

Air-admitting orifices are provided in the tube wall below the expanded portion so that air is drawn into the straw through the orifices when a liquid is sucked through the straw. The air forms bubbles at the orifices which are entrained in the liquid being sucked through the straw. As the bubbles enter the expanded portion and region of lower pressure, the flow rate of the fluid slows down giving the bubbles time to enlarge and coalesce before being sucked as a foam into the user's mouth. Drinking straws in accordance with the present invention thus provide a method of delivering liquids such as coffee, tea, soup and the like to the user's mouth in hot, delicious form without risk of burning.

A plurality of expanded portions interconnected by restricted portions may be provided. The expanded portions may be similarly sized or may increase in size in the direction of the outlet such that the bubbles increase in size as they are sucked through the drinking straw. In some embodiments, the outlet may have even greater volume than the expanded portions previously discussed. Air-admitting orifices may be provided in a restricted portion of the tube before entering that portion also.

The plurality of expanded portions may be formed as a flexible joint that allow the outlet portion of the straw to articulate with respect to a portion of the straw on the other side of the joint. The tube wall may also be formed in telescoping sections. A first section including the outlet may have a larger diameter than a second section including the inlet with the expanded portions being formed in the lower end of the first section. As the second section is slid into the first section, the second section may selectively block the orifices in the expanded sections allowing a user to control the air/liquid proportion in the foam delivered to his or her mouth.

Other means for controlling the air/liquid proportion in the foam are also described. For example, a sleeve may be provided on the outside of the tube wall for selectively blocking the orifices in the expanded sections. In other embodiments where the expanded portions form a flexible joint, contracting the joint may be used to selectively block the air-admitting orifices. When the a spiraled groove is used to form the expanded portions, the air-admitting orifices may be blocked by finger pressure in the groove.

To minimize or prevent the liquid from leaking out of the drinking straw through the air-admitting orifices, the orifices may be sloped inwardly and downwardly such that the liquid tends to be drawn back into the tube when the user stops sucking and the liquid falls back down the tube. When the orifices are formed in a nipple, the nipples may be formed inside the tube or outside the tube.

Drinking straws in accordance with the present invention may be used with conventional containers such as cups, bottles and the like. They may also be used with specially formed containers. For example, an attached lid of a cup may include an inverted pyramidal shaped cavity through which the inlet end of the straw is passed. As may be appreciated, the cavity tends to funnel any liquid that may spill from the outlet back into the container. Other examples include bottles with an attached lid in which a drinking straw with a contracted flexible joint may be received. When the lid is removed, the drinking straw may be extended as used as described above. Alternatively, the inside of the neck of the bottle may be threaded for receipt of cooperatively threaded expanded portions such that the air/liquid proportion may be controlled by threading the drinking straw up and down in the neck of the bottle.

Drinking straws in accordance with the present invention may also be provided with a means for heating the liquid before it is aerated in the expanded portions of the drinking straw. Such heating means may be electrically or chemically powered.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which:

FIG. 4 is an enlarged side elevation of a drinking straw in accordance with the present invention illustrated in partial cross-section and with the inlet end broken away, said drinking straw having adjustable air admission means;

FIG. 4A is an enlarged cross-sectional view of an air-admitting orifice in the form of an internal nipple taken from FIG. 4;

DETAILED DESCRIPTION OF THE INVENTION

Figure 1:
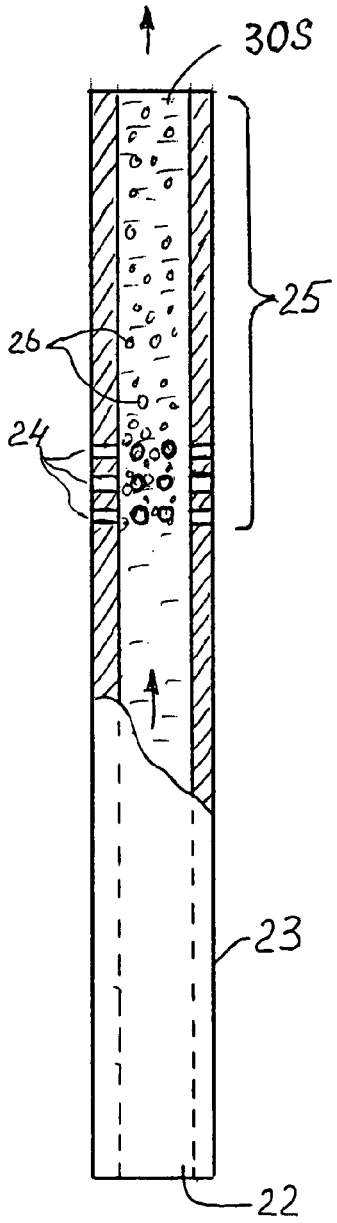
Prior Art Fig. 1
FIG. 1 is a cross-sectional view of a prior art drinking straw such as described in U.S. Pat. No. 2,943,794 to Sussman.

Referring to the drawings more particularly by reference character, as shown in FIG. 1 reference numeral 21 refers to a drinking straw in accordance with the present invention. Drinking straw 21 mainly comprises a hollow, continuous flow passage tube and includes the following connecting portions: A bottom portion 23 is intended for lowering into a drinking liquid. An area 25 includes air-admitting apertures 24 for bringing outside air into the drinking straw during suction. A top portion may perform a combination of two functions—namely, a bubble-expansion chamber and a mouthpiece.

Figure 3:
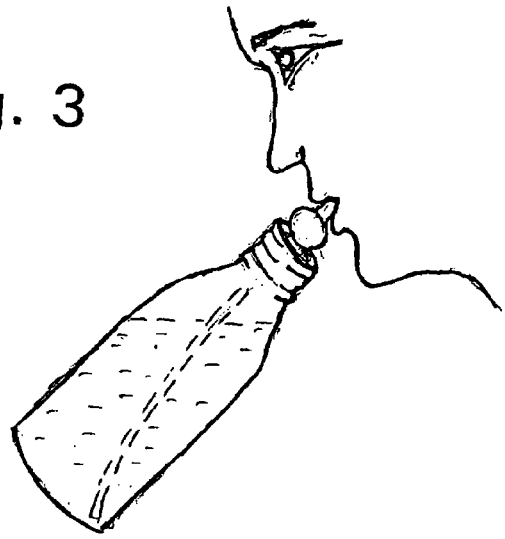
FIG. 3 is side elevation illustrating a user using a drinking straw in accordance with the present invention in combination with a bottle.
Figure 3A:
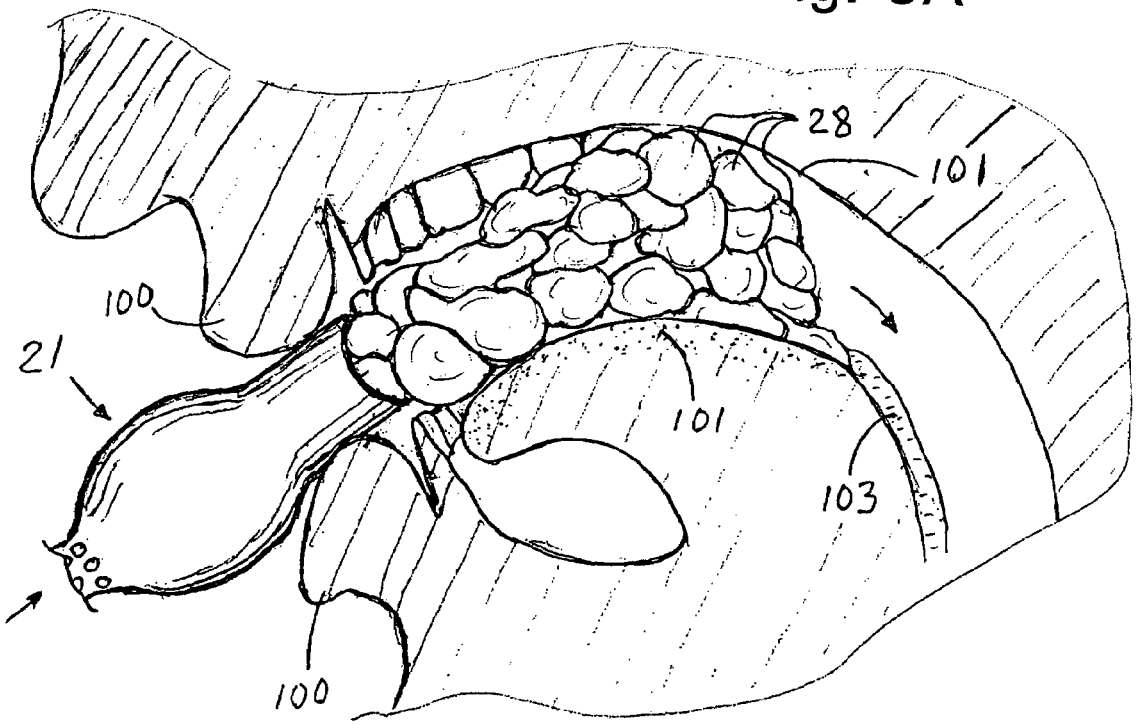
FIG. 3A is an illustrative cross-sectional view of a user's mouth during delivery of a hot liquid in a foam.

A hot liquid 26 enters a drinking straw inlet 22 when a user applies suction and travels upwards to area 25. Upon entering area 25, outside air is pulled into the liquid through air-admitting apertures 24. The aerated liquid is then pulled into an area 31. Area 31 includes a chamber 27 that has a larger volume than portion 23 within area 25. The small bubbles 26A in chamber 27 are permitted to expand in size due to the lower pressure in the chamber. Since the flow rate through chamber 27 also slows, small bubbles 26A also have more time to coalesce and form larger bubbles which then also expand. The enlarged bubbles 28 form a foam-like mixture which has a greater proportion of air than liquid. The foam exits from an outlet 30 into the user's mouth as shown in FIG. 3A. As shown in FIG. 3A, the foam passes between a user's lips 100 into oral cavity 101. The hot liquid is carried as a film on enlarged bubbles 28 and when the foam comes in contact with user's lips 100 and oral cavity 101, the foam is dissipated before the liquid passes down throat 103.

FIG. 1 shows the structure of Sussman's drinking straw with apertures for admitting air for the purpose of simulating carbonation. The same reference characters used with respect to drinking straw 21 have been applied to corresponding structures. The outlet is identified as 30S. The bubbles formed in Sussman's straw are smaller than in the straw described above.

Figure 2:
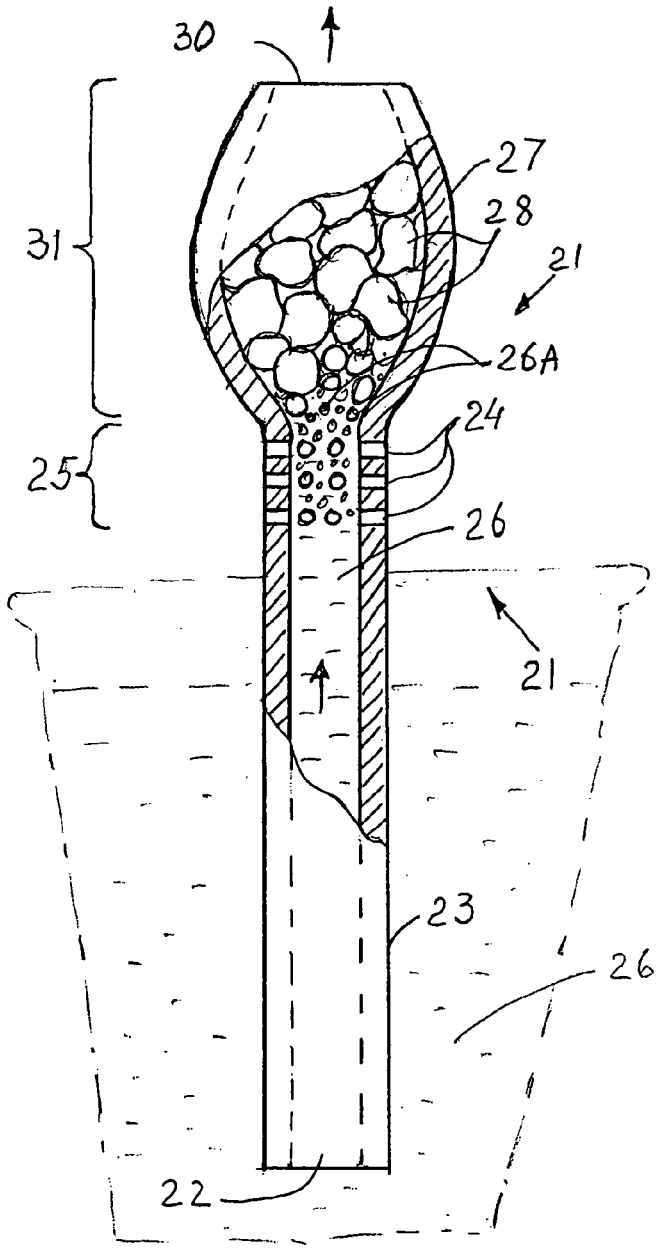
FIG. 2 is a cross-sectional view of a drinking straw in accordance with the present invention.
Figure 2A:
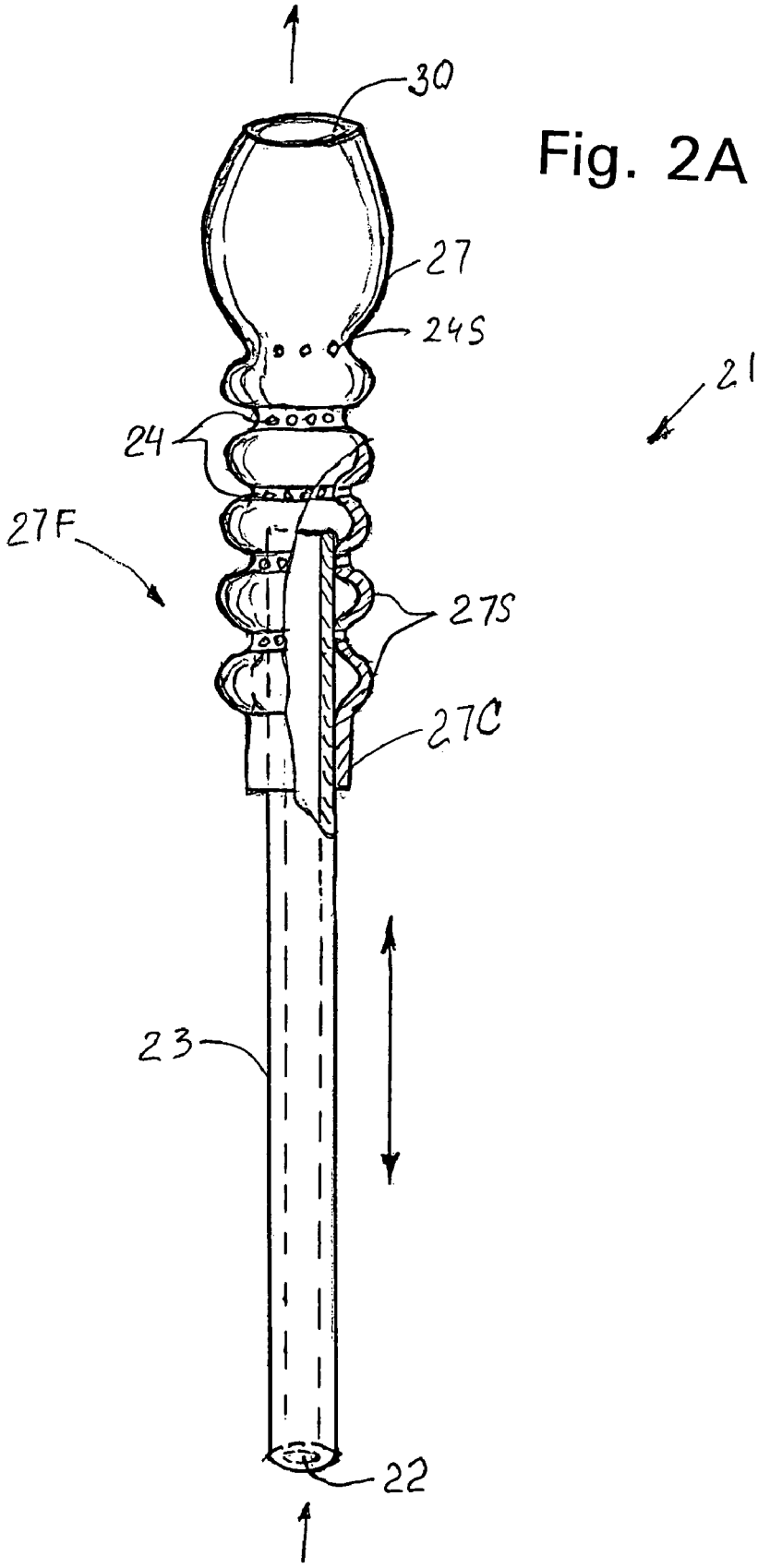
FIG. 2A is a side elevation of a multi-chambered drinking straw in accordance with the present invention illustrated in partial cross-section.

FIG. 2A shows another embodiment of the present invention wherein straw 21 is telescopic. Telescopic straw 21 includes bottom tubular part 23 with inlet 22, which is inserted into a sleeve 27C of upper tubular part 27F which is chambered. Chambered part 27F includes a plurality of chambers 27S connected to mouthpiece 27, having outlet 30. A plurality of air-admitting apertures 24 are located in areas between the chambers, said necks having smaller cross-section than the chambers. Air-admitting apertures 24S are also provided between mouthpiece 27 for admission of additional bubbles. The cross-section of necks between chambers 27S may be substantially the same as the cross-section of tube 23 such tube 23 may be slide up and down inside chambered part 27F. Telescopic movement of the parts enables opening and closing air-admitting apertures 24 and enables the user to regulate the air/liquid proportion in the foam-like mixture. A mixture having a higher proportion of air will increase the cooling effect on the hot liquid while a mixture with a lower proportion of air will decrease the cooling effect.

FIG. 4 illustrates another embodiment of the invention. A straw 21A has four major portions: Bottom portion 23D, which is intended for lowering into the liquid, is connect to chambers 27S. Chamber 27S are connected to larger cross-sectional chamber 27, which is connected to mouthpiece 29 of outlet 30. Mouthpiece 29 may have a flap 29F to protect the user's lips from heat. Chambers 27S may have air-admitting apertures constructed as nipple-like in shape. FIG. 4A is an enlarged cross-sectional view of a nipple 38N, having air inlet 24 and air outlet 50. It is preferable that outlet 50 be positioned lower than inlet 24 so that liquid may drain into the straw when suction is released and the liquid falls in the tube. In addition, nipple 38N reduces the noise of entering air. A tubular shaped regulator 38 has an inner diameter that is substantially the same as the outside diameter of chambers 27S and can be slid up or down by the user in order to open or close the desired number of air-admitting apertures. A cuff 35 of regular 38 stops movement past detent 23E. The adjustment will change the air/liquid proportion in the mixture, allowing the user to control the desired level of cooling needed to prevent burning of his or her mouth.

Figure 5:
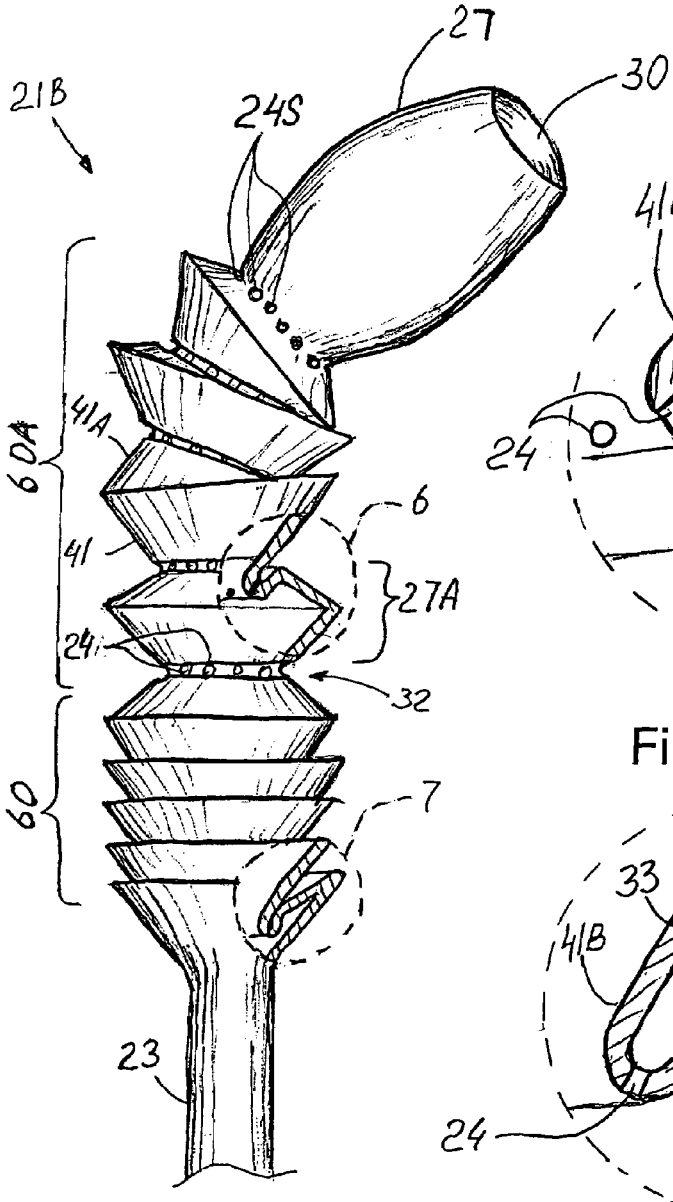
FIG. 5 is an enlarged side elevation of a drinking straw in accordance with the present invention illustrated in partial cross-section and with the inlet end broken away, said drinking straw having a flexible joint.
Figure 6:
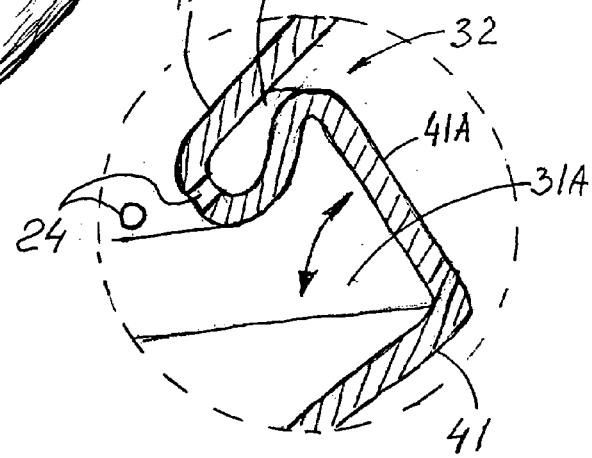
FIG. 6 is an enlarged cross-sectional view taken from FIG. 5.
Figure 7:
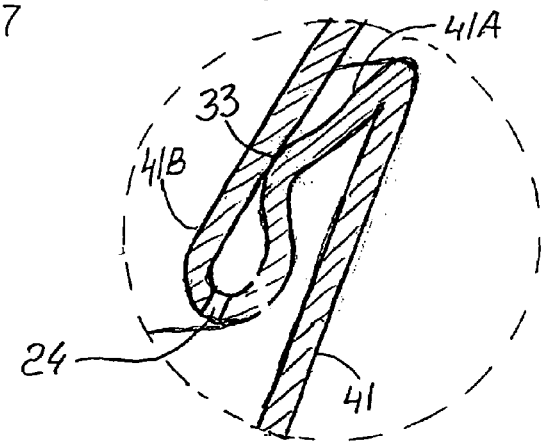
FIG. 7 is an enlarged cross-sectional view taken from FIG. 5.
Figure 8:
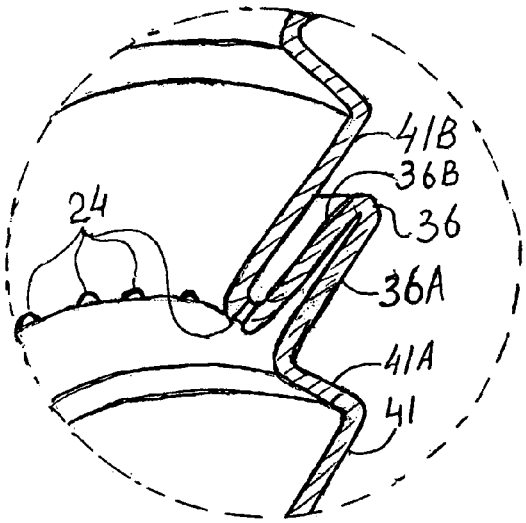
FIG. 8 is an enlarged cross-sectional view similar to FIG. 6 but having a drip-protection folding.
Figure 9:
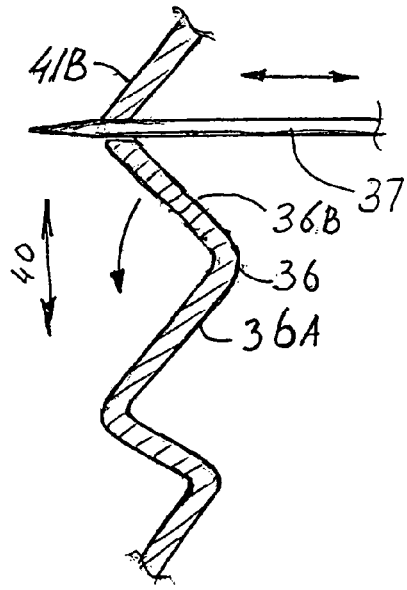
FIG. 9 is a cross-section illustrating one method of forming an air-admitting orifice in a tube wall of a drinking straw in accordance with the present invention.

FIG. 5 is represents another embodiment of the present invention. Drinking straw 21B includes a flexible joint which may be variant of the joint described in U.S. Pat. No. 3,409,224 to Harp which is incorporated by reference herein. Sides 41 and 41A, when in unfolded position form foam generating and mixing chambers 27A. Each chamber connects to an adjacent chamber by means of air admitting apertures formed in grooves 32 which are shown in enlarged cross-section in FIG. 6. Grooves 32 have air-admitting openings 33, which permit outside air to be drawn into the straw through apertures 24. It is preferred that apertures 24 be positioned lower than opening 33 to prevent egress of liquid from escaping the straw. FIG. 7 is an enlarged cross-section view of one of the chambers in a collapsed position, in which air admission is restricted. In the collapsed position, groove 32 and tube wall 41B seal air admission to apertures 24. In FIG. 5, reference character 60 refers to a region wherein the chambers are collapsed and reference character 60A refers to a region where the chambers as expanded. The embodiment shown in FIG. 5 allows the user to open and close the desired number of chamber and air admitting apertures to regulate the air/liquid proportion of the foam mixture for temperature adjustment. FIG. 8 is a cross-sectional view of a variant of air-admitting fold 36 with side walls 36A and 36B shown in FIG. 6. FIG. 9 illustrates a way in which a needle 37 may be used to form apertures 24 in air-admitting fold 36 which is illustrated partially unfolded.

Figure 10:
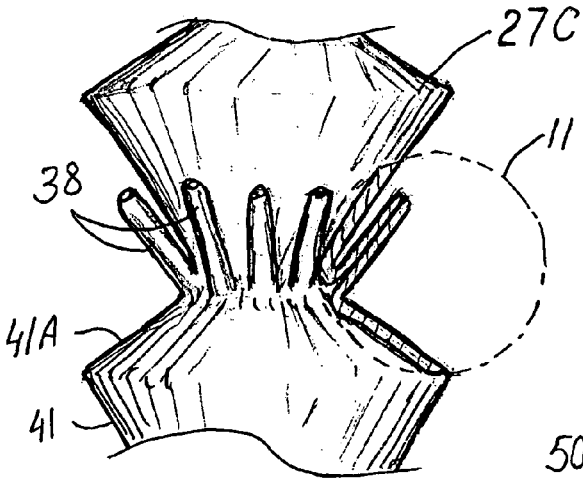
FIG. 10 is an enlarged side elevational view of a drinking straw in accordance with the present invention with the air-admitting orifices in the form of external nipples.
Figure 11:
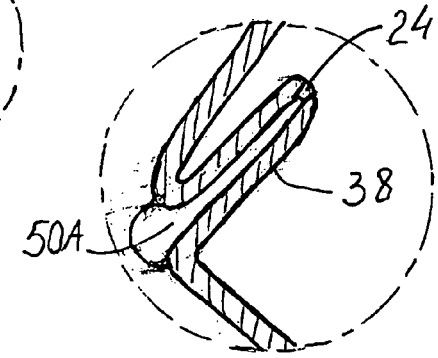
FIG. 11 is an enlarged cross-sectional view taken from FIG. 10.

FIG. 10 is a partial view of a further embodiment of the invention with mixing chambers 27C where air-admitting apertures 24 may be positioned on the tip of external nipples. FIG. 11 is an enlarged view of external nipples 38. As shown, aperture 24 is preferably positioned higher than air outlet 50A to prevent the liquid from escaping from the straw.

Figure 12:
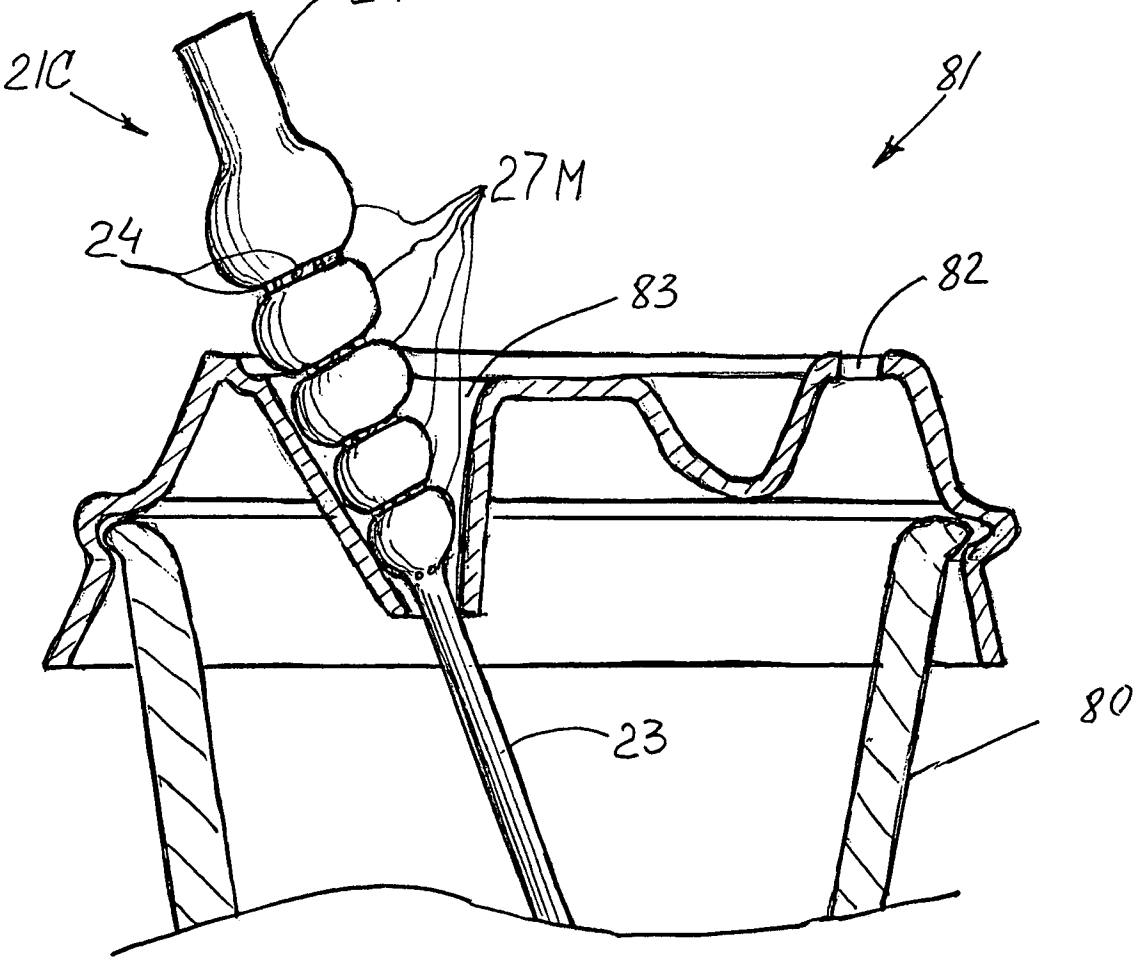
FIG. 12 is a side elevational view of a cup with an attached novel cup lid in cross-section illustrated with a multi-chambered drinking straw in accordance with the present invention.

FIG. 12 demonstrates a combination of a novel straw 21C with a novel container lid 81 for a container 80 with an air hole 82. Novel lid 81 includes an inverted pyramidal shaped cavity 83 for preventing the escape and funneling collected liquid back into the container. Plurality of chambers 27M have increasing volume in the direction of upper bulbous chamber 27.

Figure 14:
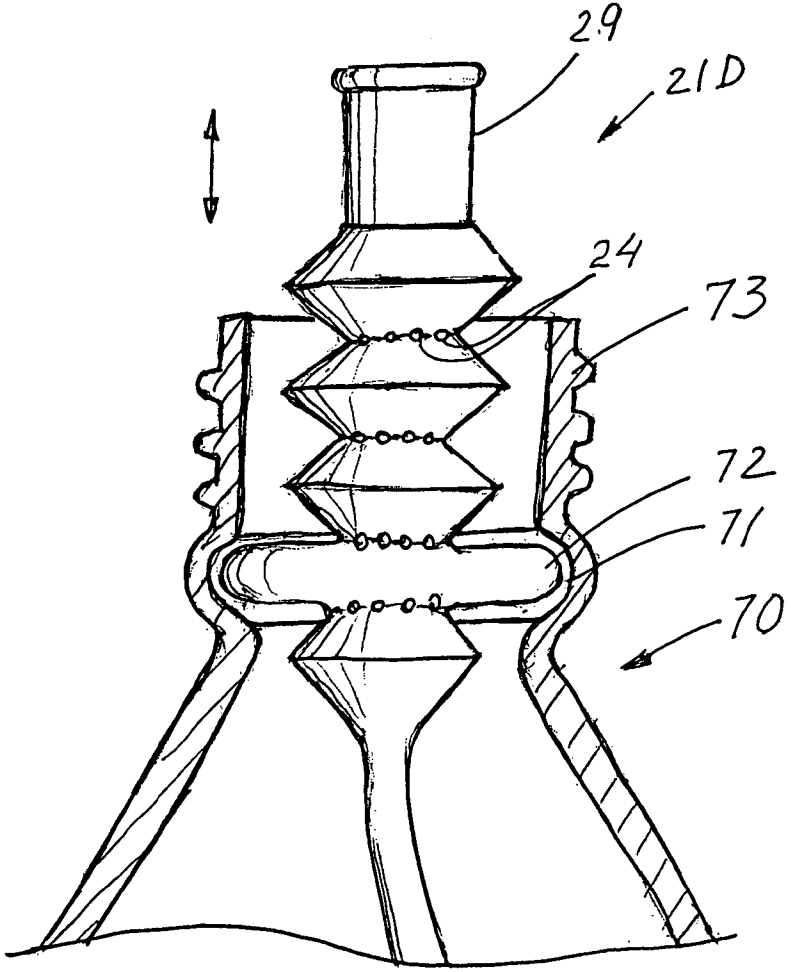
FIG. 14 is an enlarged side elevational view of the bottle shown in FIG. 13 with the lid detached and with the flexible joint extended.
Figure 13:
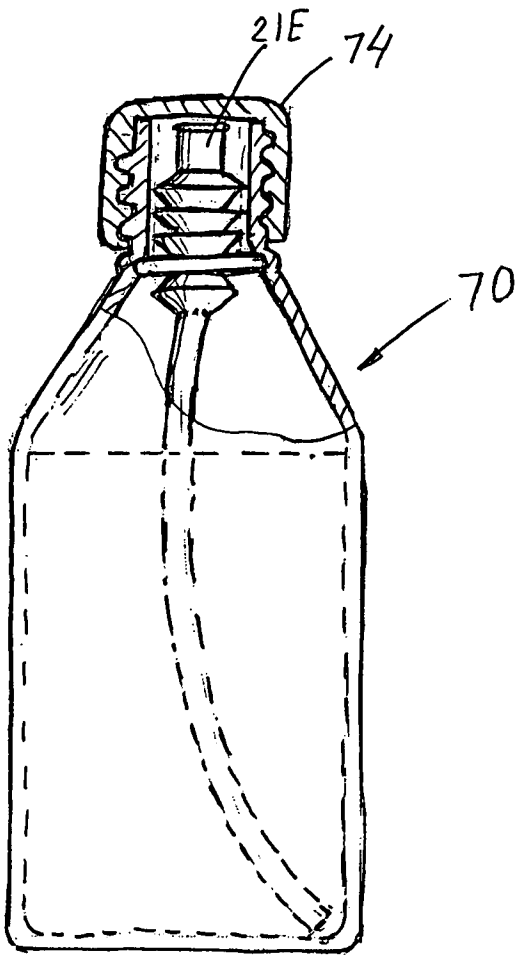
FIG. 13 is a side elevational view of a bottle in cross-section with an attached threaded lid illustrated with a drinking straw with a flexible joint, said joint in contracted condition.

FIG. 13 is a cross-sectional view of a combination of a novel straw 21E with a bottle 70 with a threadedly attached lid 74. FIG. 14 is an enlarged cross-section view corresponding to FIG. 13 of a novel straw 21D with lid 74 removed exposing threads 73. A side wall 71 of one of chambers 72 may serve as a stop preventing the removal of the straw from bottle 70.

Figure 16:
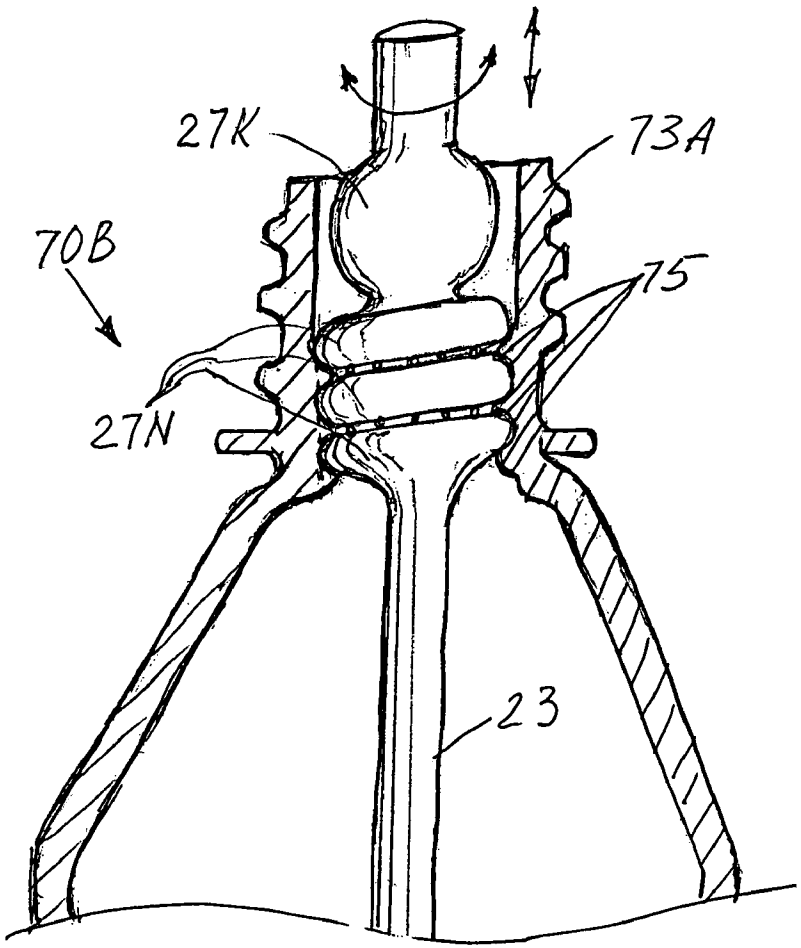
FIG. 16 is an enlarged side elevation view of a top portion of a bottle with a threaded neck illustrated with a drinking straw in accordance with the present invention having a screw-type of air adjustment means.
Figure 15:
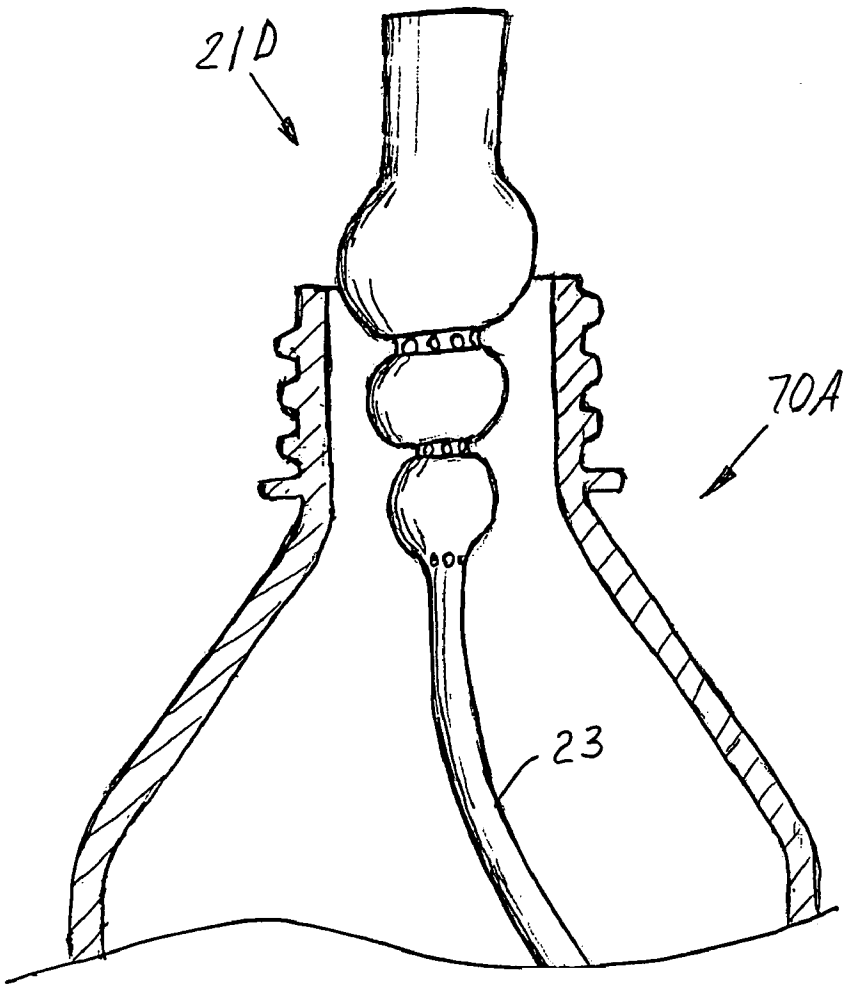
FIG. 15 is an enlarged side elevational view of a top portion of a bottle with an open neck illustrated with a multi-chambered drinking straw in accordance with the present invention.

FIG. 15 depicts another embodiment of the combination of a drinking straw 21D in accordance with the present invention with a bottle 70A. FIG. 16 shows a further embodiment of the combination of a novel straw 21K with a bottle 70B utilizing a screw type design wherein chambers 27N screw into threads 75 provided in the neck of the bottle thereby providing air-adjusting means.

Figure 17:
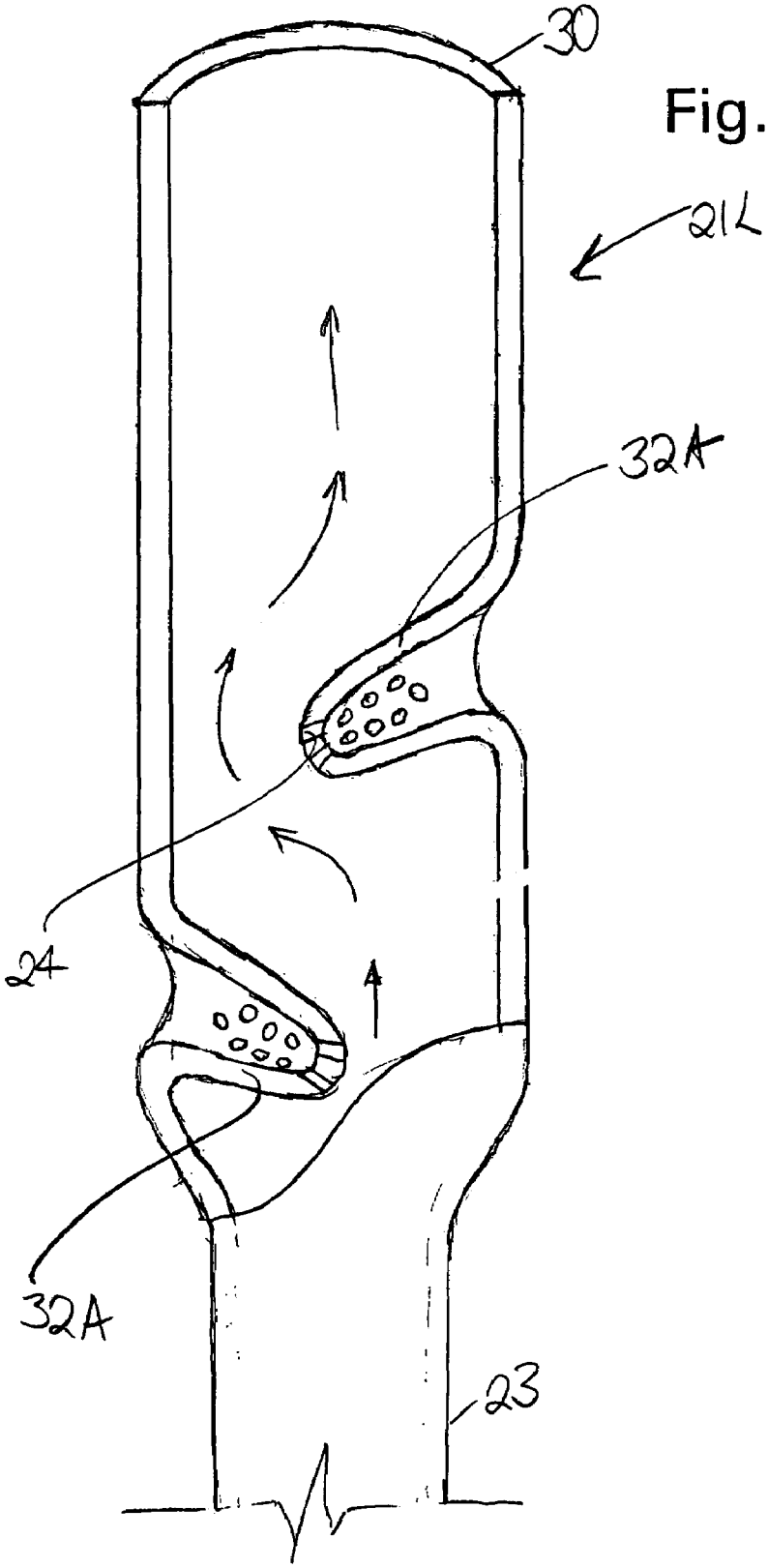
FIG. 17 is an enlarged cross-section of a drinking straw in accordance with the present invention with the inlet end broken away, said drinking straw having air-admitting orifices which may be blocked with the user's fingers; and, FIG. 18 is an enlarged cross-section of a drinking straw in accordance with the present invention illustrated with a heating means for heating the liquid as it is sucked through the straw.

FIG. 17 shows a still further example of a drinking straw 21L in accordance with the present invention. As shown downwardly sloped grooves 32A form air-admitting nipples 38M proximate the inlet end. Groove is sufficiently wide that the user may use his or her fingers to block air-admitting apertures 24 and control the air/liquid proportion of the foam.

Figure 18:
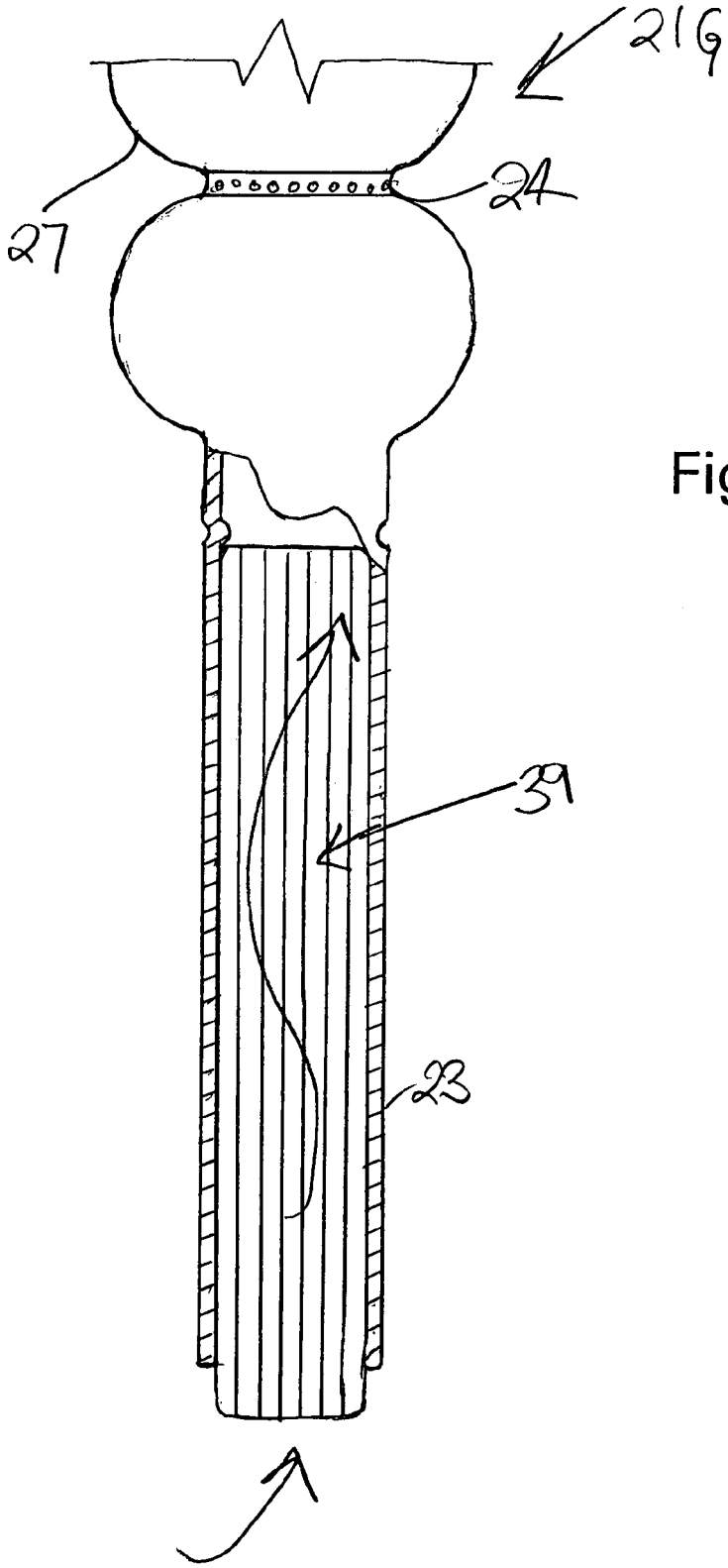

FIG. 18 illustrates a drinking straw 21G wherein a heating means 39 is provided for heating the liquid before it is admixed with air. Heating means 39 may be powered by an electrical or chemical heating source as will occur to one skilled in the art. It will also be apparent that heating means 39 may be located outside drinking straw in the container from which the liquid is being sucked. Such self-heating containers are known in the art.

In view of the above, it will be seen that the several objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. A drinking straw having:

a tube wall;

an inlet on a lower end and an outlet on an upper end of the straw;

said straw having at least one restricted portion with a plurality of nipples formed in the tube wall of the restricted portion;

said restricted straw portion being interconnected with a straw portion of a larger cross section;

each nipple having one or more air-admitting orifices whereby air is drawn into the straw through the orifices when a hot liquid is sucked through the drinking straw, said air forming bubbles at the orifices, said bubbles coalescing and enlarging in the straw portion of a larger cross section before being admitted into a user's mouth, wherein the hot liquid is carried as a thin film surrounding each of the air bubbles.

2. A drinking straw having a tube wall, an inlet on a lower end and an outlet on an upper end, said tube wall having a plurality of expanded portions interconnected by restricted portions proximate the outlet with one or more inwardly and downwardly sloped air-admitting orifices in the tube wall in the restricted portion below each expanded portion whereby air is drawn into the straw through the orifices when a hot liquid is sucked through the drinking straw, said air forming bubbles at the orifices which enlarge in the expanded portions before being sucked as a foam into a user's mouth.

3. A drinking straw of claim 2 wherein the air-admitting orifices are located on a lower end of inwardly directed nipples.

4. A drinking straw of claim 2 wherein the air-admitting orifices are located on the upper end of outwardly directed nipples.

5. A drinking container with an open end in which is placed a drinking straw having a tube wall, an inlet on a lower end and an outlet on an upper end, said tube wall having at least one expanded portion proximate the outlet with one or more air-admitting orifices in the tube wall below the expanded portion whereby air is drawn into the straw through the orifices when a hot liquid is sucked through the drinking straw, said air forming bubbles at the orifices which enlarge in the expanded portion before being sucked as a foam into a user's mouth.

6. The drinking container of claim 5 wherein the container is a cap with a detachable lid through which the drinking straw is passed.

7. The drinking container of claim 5 wherein the container is bottle with a neck through which the drinking straw is passed.

8. A method of delivering hot liquids into the mouth of a user in the form of enlarged bubbles substantially less likely to burn the user's mouth, said method comprising:

providing a drinking straw having a tube wall, an inlet on a lower end and an outlet on an upper end of the straw, said tube wall having at least one restricted portion with a plurality of nipples in the tube wall, each nipple having one or more air-admitting orifices;

said restricted straw portion being interconnected with a straw portion of a larger cross section;

forming air bubbles at the orifices by sucking hot liquid through the drinking straw, said air forming bubbles at the orifices, said bubbles enlarging and coalescing in the straw portion of a larger cross section before being sucked into a user's mouth, wherein the hot liquid is carried as a thin film surrounding each of the air bubbles.

9. The method of claim 8 wherein the tube of the drinking straw has a plurality of restricted portions, said restricted portions having nipples with air-admitting orifices in the tube wall and a heating means in the tube below the air-admitting orifices for heating the liquid, said heating means powered by an electrical or chemical heating source, said method further comprising:

activating the heating means; and, sucking liquid through the inlet whereby it is heated into a hot liquid before it is delivered in form of the enlarged bubbles into the user's mouth.

* * * * *